United States Patent [19]

Mackal et al.

[11] Patent Number: 5,026,310

[45] Date of Patent: Jun. 25, 1991

[54] ELECTRIC AUTOINFLATOR

[75] Inventors: Glenn H. Mackal, St. Petersburg; Jacek H. Weinheimer, Treasure Island, both of Fla.

[73] Assignee: Halkey-Roberts Corporation, St. Petersburg, Fla.

[21] Appl. No.: 486,592

[22] Filed: Feb. 28, 1990

[51] Int. Cl.[5] ..... B67B 7/24

[52] U.S. Cl. ..... 441/93; 441/92

[58] Field of Search ..... 441/80, 88, 90, 92-95, 441/8, 9; 222/3, 5, 52, 54; 141/17, 19, 329, 330, 363

[56] References Cited

U.S. PATENT DOCUMENTS

| | | | |
|---|---|---|---|
| 3,744,816 | 7/1973 | Yamaguchi | 441/101 |
| 4,482,081 | 11/1984 | Meggs | 441/98 |
| 4,500,014 | 2/1985 | Zimmerly | 441/95 |
| 4,585,190 | 4/1986 | Hansen | 441/95 |
| 4,687,451 | 8/1987 | Chen | 441/95 |

*Primary Examiner*—Joseph F. Peters, Jr.
*Assistant Examiner*—Clifford T. Bartz
*Attorney, Agent, or Firm*—Dominik, Stein, Saccocio, Reese, Colitz & Van Der Wall

[57] ABSTRACT

A water-activated, squib-powered inflator for fracturing a frangible seal of a gas cartridge allowing the gas therein to flow into an inflatable drive.

10 Claims, 2 Drawing Sheets

ELECTRIC AUTOINFLATOR

BACKGROUND OF THE INVENTION

1. Field of the Invention

This invention relates to automatic actuators commonly used in conjunction with inflators for inflating articles such as personal flotation devices, rafts, buoys and emergency signaling equipment. More particularly, this invention relates to squib powered, water activated actuators which are automatically actuated upon immersion in water or other fluid.

2. Description of the Background Art

Presently, there exist many types of inflators designed to inflate inflatable articles such as personal flotation devices (life vests, rings and horseshoes), life rafts, and emergency signaling equipment. These inflators typically comprise a body for receiving the neck of a cartridge of compressed gas such as carbon dioxide. A reciprocating pierce pin is disposed within the body for piercing the frangible seal of the cartridge to permit the compressed gas therein to flow into a manifold in the body and then into the device to be inflated. Typically, a manually movable firing lever is operatively connected to the piercing pin such that the piercing pin pierces the frangible seal of the cartridge upon jerking of a ball lanyard. U.S. Pat. No. 3,809,288, the disclosure of which is hereby incorporated by reference herein, illustrates one particular embodiment of a manual inflator.

While these manual inflators work suitably well, it was quickly learned that in an emergency situation, the person needing the assistance of the inflatable device, such as a downed aviator, injured person, or a man overboard, would fail or be unable to manually actuate the inflator. Accordingly, it was realized that a means should be provided for automatically actuating the inflator in such an emergency situation.

In response to this need, water activated automatic inflators have been developed which, when exposed to a fluid such as water, automatically actuate the piercing pin of the inflator causing inflation of the inflatable device.

One type of water activated automatic inflators comprise a water activated trigger assembly including a water dissolvable element which retains a spring-loaded actuator pin in a cocked position in alignment with the pierce pin, either directly or indirectly by means of an intermediate transfer pin. Upon exposure to water, the element dissolves allowing firing of the cocked actuator pin. The actuator pin then strikes the pierce pin to fracture the seal of the cartridge thereby allowing the gas contained therein to flow into the inflatable device to inflate the same. U.S. Pat. Nos. 3,997,079, 4,223,805 4,267,944, 4,260,075 and 4,627,823 the disclosures of each of which are hereby incorporated by reference herein, illustrate several examples of water activated automatic inflators.

While the above automatic inflators work quite well to automatically inflate the inflatable device in the event of an emergency situation, one major disadvantage to these automatic inflators is their tendency to self-actuate while stored for subsequent exigent use. Specifically, it is quite common for the automatic inflator to be stored in a highly humid environment such as on a ship or a boat. Over a period of time, the moisture contained within the humid air is absorbed by the water dissolvable element to such a degree that the element is weakened, particularly since the element is continually subjected to the force of the actuator spring. As the element gradually weakens, the strength of the element eventually becomes insufficient to retain the spring-loaded actuator pin in the cocked position. When the element collapses under the force of the compressed spring of the actuator pin, the actuator pin strikes the piercing pin causing premature and unintentional inflation of the inflatable device.

The problem of premature and unintentional actuation of the automatic inflator is so acute that it is not uncommon for a weakened water destructible or dissolvable element to be replaced with a new element on a periodic basis pursuant to a regularly scheduled maintenance plan. In this regard, it is noted that each of the prior art water activated automatic inflators disclosed in the above referenced patents teach a structure which may easily be disassembled to facilitate removal of a weakened element and the installation of a new one. Indeed, U.S. Pat. No. 4,627,823 discloses a safety-latched automatic actuator designed to relieve the pressure exerted on the water dissolvable element until such time as an emergency situation exists.

Another type of water activated automatic inflators comprise a water activated, squib powered inflator. As the term is commonly used, a squib is a self-contained explosive charge. Upon actuation by electric current, the explosive charge explodes and actuates the inflator. U.S. Pat. Nos. 3,059,814, 3,091,782, 3,426,942, 3,579,964, 3,702,014, 3,757,371, 3,910,457, 4,382,231, 4,436,159 and 4,513,248, the disclosures of each of which are incorporated by reference herein, illustrate several examples of water activated squib-powered inflators.

Unfortunately, many designs of the water activated squib powered inflators do not provide for replacement of the squib after firing, thereby necessitating the return of the inflator to the factory for recharging. Likewise, it is important to conveniently replace the batteries that power the squib so that a periodic maintenance program can be implemented. Finally, it is important to protect the water sensing electrodes and associated electronics from damage in the event the inflator is dropped or otherwise abused, without compromising the water flow in and around the electrodes when the inflator is exposed to water and requires immediate actuation. In addition to protecting the electrodes, it is usually desirable to be able to quickly replace the electrodes and associated electronics in the event of suspected or actual damage or inoperability of the same.

Therefore, it is an object of this invention to provide an apparatus which overcomes the aforementioned inadequacies of the prior art devices and provides an improvement which is a significant contribution to the advancement of the water-activated, squib-powered, inflator art.

Another object of this invention is to provide a water-activated squib-powered inflator for inflating inflatable devices which allows quick and easy replacement of the squib after firing or as otherwise desired.

Another object of this invention is to provide a water-activated squib-powered inflator which allows the quick and easy replacement of the batteries that power the squib and associated electronics.

Another object of this invention is to provide a water-activated squib-powered inflator having water sensing electrodes which are protected from damage in the event the inflator is dropped or otherwise abused while still permitting rapid flow of water in and around the electrodes to sense the same when the inflator is exposed to water.

Another object of this invention is to provide a water-activated, squib-powered inflator in which the water sensing electrodes and associated electronics may be quickly and easily replaced in the event of suspected or actual damage or as otherwise desired.

The foregoing has outlined some of the more pertinent objects of the invention. These objects should be construed to be merely illustrative of some of the more prominent features and applications of the intended invention. Many other beneficial results can be obtained by applying the disclosed invention in a different manner or modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

SUMMARY OF THE INVENTION

The invention is defined by the appended claims with a specific embodiment shown in the attached drawings. For the purpose of summarizing the invention, the invention comprises a water activated, squib powered inflator for use in conjunction with inflatable devices such as personal flotation devices, life rafts, buoys and emergency signaling equipment. More particularly, the inflator of the invention comprises a squib assembly and a reciprocatable pierce pin mounted in line within an elongated body. The squib assembly comprises a squib and a reciprocable piston pin mounted within a watertight sealed housing. A threaded insert is molded in the body in alignment with the pierce pin for receiving a conventional cartridge containing compressed gas such as carbon dioxide. The body further comprises a battery compartment positioned parallel to the in line squib assembly and pierce pin. A cap containing water sensing electrodes and associated electronics, sealingly engages over the end of the body and is secured to the body by a large headed thumb screw. A manual actuator may be incorporated in the body to manually actuate the pierce pin.

Upon actuation of the squib assembly, the squib explodes and forces the piston pin to fracture the end of the housing and impact the pierce pin. The pierce pin is then forceably urged rearwardly to fracture the seal of the cartridge, thereby releasing the compressed gas to inflate the inflatable device.

The design of the body and cap of the inflator of the invention allows the user to quickly replace the squib assembly after firing. Factory recharging of the inflator is, therefore, alleviated. Likewise, access to the battery compartment allows quick replacement of the battery as needed.

The positioning of the water sensing electronics within the cap offers several advantages. First, the electrodes of the electronics protrude from the upper surface of the cap and are shielded from damage by the enlarged thumb screw in the event the inflator is dropped or otherwise abused. Water, however, is still allowed to flow within the air space under the thumb screw to contact the electrodes. Furthermore, a test electrode may be similarly positioned under the thumb screw allowing the electronics to be tested. Finally, the entire cap may be quickly replaced with a new one in the event the electronics are suspected of being, or are, defective.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which.

Similar reference characters refer to similar parts throughout the several views of the drawings.

DETAILED DESCRIPTION OF THE PREFERRED EMBODIMENT

Figure 1:
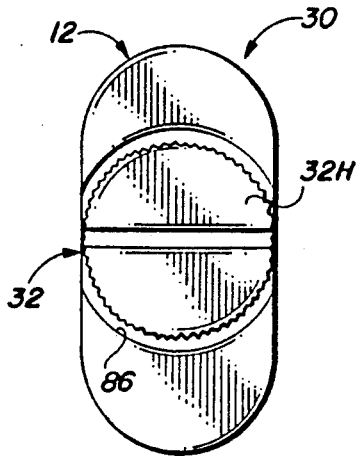
FIG. 1 is an end view of the water activated, squib powered inflator of the invention illustrating the thumb screw having an enlarged head which secures the cap over the end of the inflator.
Figure 2:
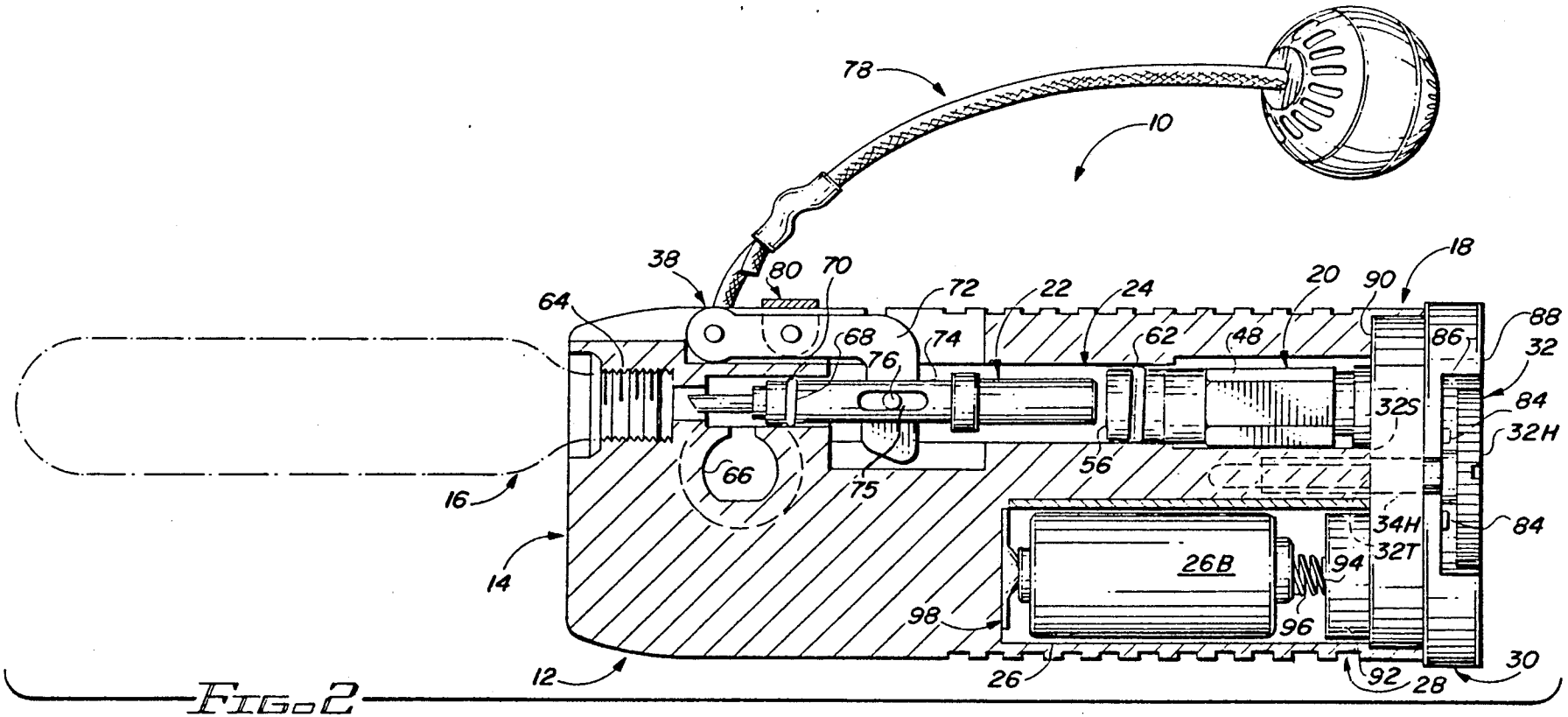
FIG. 2 is a longitudinal cross-sectional view of FIG. 1 illustrating the in line positioning of the pierce pin and the squib assembly within the body of the inflator.

Referring to FIGS. 1 and 2, the inflator 10 of the invention comprises an oval-shaped elongated body 12 having a cartridge receiving rearward end 14 for threadably mounting a gas cartridge 16 and a cap receiving forward end 18. A squib assembly, generally indicated by numeral 20, and a reciprocatable forked pierce pin 22 are serially positioned in line with each other in longitudinal hole 24 through the body 12. The body 12 further comprises a battery compartment 26 for receiving a battery 26B and having an opened end 28 opening to the cap receiving end 18. A cap, generally indicated by numeral 30, is configured to sealingly engage over the cap receiving end 18 of the body 12 by means of a thumb screw 32 having an enlarged head 32H and threaded shank 32S which extends through a hole 34H in the cap 30 and threadably engages a threaded hole 36T of body 12. The inflator 10 may include a manual actuator 38 to allow manually firing of the cartridge 16.

Figure 3A:
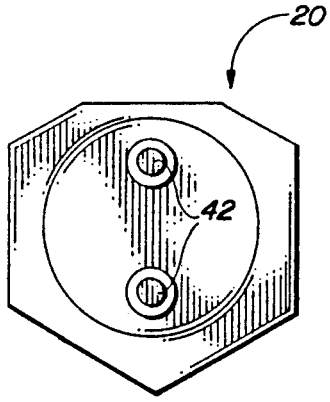
FIG. 3*a* and 3*b* are an end view and a longitudinal cross-sectional view of the preferred embodiment of the squib assembly comprising a squib and reciprocatable pierce pin mounted with a hermetically sealed housing.
Figure 3B:
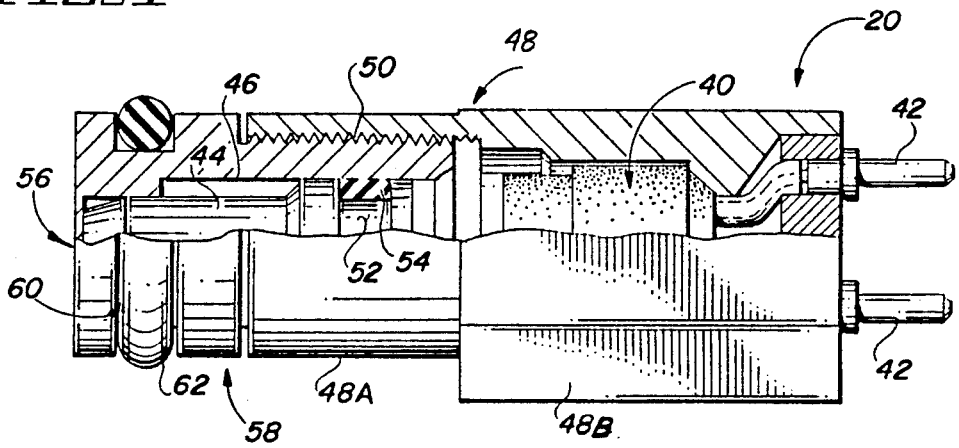

More particularly, as shown in FIG. 3, squib assembly 20 comprises an explosive squib 40 which is actuable by electric current applied to its terminals 42 and a reciprocatable piston pin 44. The squib 40 and piston pin 44 are contained within a central bore 46 in a hermetically sealed housing 48 composed of two sections 48A and 48B threadably secured together at thread 50. The piston pin 44 comprises at least one O-ring groove 52 for sealing against the lumen of the central bore 46 by means of a conventional O-ring 54 such that upon explosion of squib 40, the piston pin 44 is forced rearwardly to fracture a frangible end 56 of housing 48A and impact the pierce pin 22 and force it forwardly to puncture the seal of the gas cartridge 16.

It is noted that the rearward portion 58 of the housing 48 preferably includes at least one O-ring groove 60 for receiving a conventional O-ring 62 to seal the housing 48 within the hole 24 in the body 12 and prevent leakage of water therein through manual actuator 38.

Returning to FIG. 2, the pierce pin 22 comprises an elongated forked design having a length which extends between the frangible end 56 of the housing 48 of the squib assembly 20 to a threaded insert 64 molded in situ within body 12 that receives the threaded neck of the gas cartridge 16. A manifold 66 is positioned transversely through body 12 in fluid communication with the rearward portion of the hole 24. Pierce pin 22 includes an O-ring groove 68 for receiving a conventional O-ring 70 to prevent leakage of the released gas from the gas cartridge 16 out of hole 24 and to prevent leakage of water therein through manual actuator 38.

The manual actuator 38 is conventional in the art and includes a dog legged lever 72 having one end pivotably connected within a slot 74 in the forked pierce pin 22 and secured into position by pivot pin 76. A ball lanyard 78 is then secured to the other end of the lever 72. A locking clip 80 may be provided for releasably securing the lever 72 against the body 12. During use, when the ball lanyard 78 is pulled, clip 80 pops off and lever 72 pivots on pivot pin 76 causing its end to cam against the bottom of the slot 74 in the pierce pin 22 and force it forwardly to pierce the seal of the gas cartridge 16. Slot 75 is provided to allow the pierce pin 22 to reciprocate within hole 24 without requiring actuation of the manual actuator 38.

Figure 4:
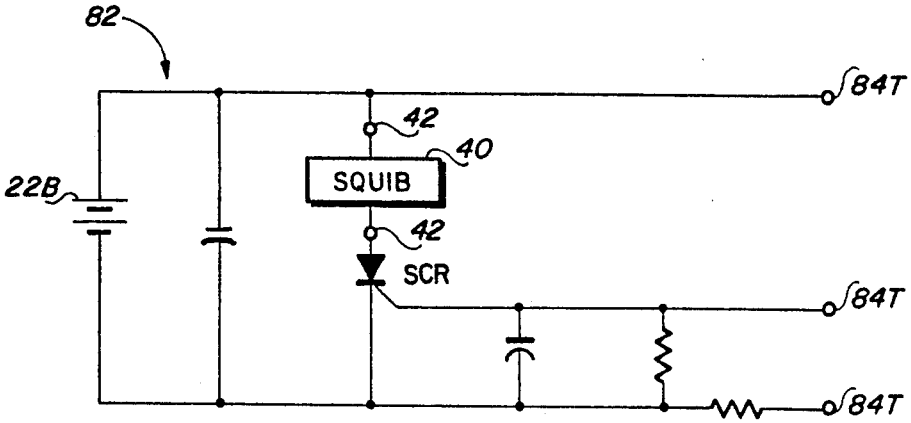
FIG. 4 is a schematic diagram of the electronics for sensing the presence of water and then supply current from the battery to the terminals of the squib assembly.

The cap 30 contains all of the water sensing electronics 82 which sense the presence of water via a pair of electrodes 84. More specifically, as shown in FIG. 4, the water sensing electronics 82 comprise a silicon controlled rectifier (SCR) or other semiconductor which functions to sense the resistance between the pair of electrodes 84 and when such resistance falls below a predetermined amount upon being submersed in water, closes to provide electrical current from the battery 22B to the terminals 42 of the squib 40 to fire the same. A test electrode 84T is provided for testing the voltage of the battery 22B without firing the squib 40.

Returning again to FIG. 2, the tips of the electrodes 84 extend into a recess 86 formed in the outer surface 88 of the cap 30. Recess 86 is configured to allow the head 32H of the thumb screw 32 to be recessed therein, or at least flush with the outer surface 88, when the cap 30 is sealingly secured over the end 18 of the body 12. The diameter of the head 32H is appreciably smaller than the diameter of the recess 86 so as to allow water to flow past the head 32H into the recess 86. However, as shown in FIG. 1, the diameter of the head 32H of the thumb screw 32 is preferably substantially equal to or appreciably greater than the shorter width of the body 12 so as to allow gripping of the head 32H with a person's thumb and forefinger thereby allowing threading and unthreading thereof. Notably, the positioning of the head 32H of the thumb screw 32 in the recess 86 under the head 32H of the thumb screw 32 functions to protect the electrodes 84 and 84T from abuse while allowing water or other fluid to flow into the recess 86 to contact the electrodes 84 and 84T. The enlarged head 32H also protects the electrodes 84 and 84T from static electricity that could result in unintended firing of the squib 40.

The inner surface 90 of the cap 30 includes contacts for making electrical contact with the terminals 42 (which are preferably potted) of the squib assembly 20 when the cap 30 is secured over the end 18 of the body 12. Similarly, the inner surface 90 of the cap 30 includes a cylindrical protrusion 92 in alignment with the battery compartment 26 to extend therein. Protrusion 92 includes a center contact 94 which is electrically connected to the anode terminal of the battery 26B via spring 96. Electrical contact is made with the cathode terminal of the battery 26B via metal strip 98 which extends from the bottom of the battery compartment 26, along its vertical wall to contact 94 of protrusion 92.

It is noted that the positioning of the electronics 82 within the cap 30 facilitates simple replacement of the cap 30 (and the electronics 82) in the event the electronics 82 become, or are suspected of being, defective. Moreover, the removability of the cap 30 allows the user to conveniently replace the battery 26B periodically and to conveniently replace the squib assembly 20 as desired.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit of the invention.

Now that the invention has been described,

What is claimed is:

1. A water-activated, squib-powered inflator for fracturing a frangible seal of a gas cartridge allowing the gas therein to flow into an inflatable device, comprising in combination:

a body including a longitudinal hole having a rearward end for receiving the gas cartridge allowing the gas therein to flow into the inflatable device via a manifold connected in fluid communication with said longitudinal hole;

a pierce pin reciprocatably mounted within said longitudinal hole for fracturing the frangible seal of the gas cartridge when urged rearwardly;

a squib assembly positioned within said longitudinal hole forwardly of said pierce pin, said squib assembly including a piston pin and an electrically actuable explosive charge, said piston pin and said charge being positioned within a housing dimensioned to slidably fit within said longitudinal hole in alignment with said pierce pin, said housing comprising a frangible rearward end, said squib assembly further including terminal means for transmitting electrical energy supplied thereto to said explosive charge to actuate same;

cap for sealingly positioning at said forward end of said body; and water sensing means in said cap for sensing the presence of water and transmitting electrical energy from battery to said terminal means of said squib assembly to actuate said explosive charge, whereby said piston pin of said squib assembly is forcibly urged rearwardly to fracture said frangible rearward end and impact said pierce pin and forcibly urge said pierce pin rearwardly to pierce the frangible seal of the gas cartridge allowing the gas contained therein to flow through said longitudinal hole and said manifold into the device to be inflated.

2. The inflator as set forth in claim 1, wherein said water sensing means comprises at least one electrode positioned exterially of said cap for sensing the presence of water.

3. The inflator as set forth in claim 2, wherein said cap is secured to said forward end of said body by means of a fastener having an enlarged head and wherein said electrode is positioned under said head of said fastener.

4. The inflator as set forth in claim 3, wherein said electrode is positioned exterially of said cap in a recess formed within said cap.

5. The inflator as set forth in claim 4, wherein said head comprises a configuration substantially similar to but appreciably smaller than said recess such that water is allowed to flow into said recess about the periphery of said head.

6. The inflator as set forth in claim 5, wherein said head is recessed within said recess.

7. The inflator as set forth in claim 3, wherein said body comprises a substantially oval-shaped cross-sectional configuration having a shorter width substantially equal to or appreciably smaller than the width of said head such that said head may be grasped to fasten or release said cap to said body.

8. The inflator as set forth in claim 7, further comprising a head recessed within said recess.

9. The inflator as set forth in claim 1, wherein said battery compartment containing the battery is positioned substantially parallel to said longitudinal hole.

10. The inflator as set forth in claim 9, wherein said cap further includes a protrusion extending into said battery compartment.

* * * * *